US005309814A

United States Patent [19]

Mossberg

[11] Patent Number: 5,309,814

[45] Date of Patent: May 10, 1994

[54] HOME SECURITY BARREL ASSEMBLY

[75] Inventor: Alan I. Mossberg, St. Petersburg, Fla.

[73] Assignee: O. F. Mossberg & Sons, Inc., North Haven, Conn.

[21] Appl. No.: 896,306

[22] Filed: Jun. 10, 1992

[51] Int. Cl.[5] ..... F41A 21/46

[52] U.S. Cl. ..... 89/14.6; 42/79

[58] Field of Search ..... 42/76.01, 79; 89/14.05, 89/14.2, 14.3, 14.6

[56] References Cited

U.S. PATENT DOCUMENTS

| | | | |
|---|---|---|---|
| 819,834 | 5/1906 | Zalinski | 89/14.05 |
| 3,628,415 | 12/1971 | McElroy | 89/14.3 |
| 3,665,804 | 5/1972 | Rohr | 89/14.3 |
| 4,446,771 | 5/1984 | Anthony et al. | 89/14.6 |

FOREIGN PATENT DOCUMENTS

| | | | |
|---|---|---|---|
| 310679 | 6/1921 | Fed. Rep. of Germany | 89/14.05 |
| 2466 | of 1865 | United Kingdom | 89/14.3 |
| 12003 | of 1897 | United Kingdom | 89/14.6 |
| 124779 | 4/1919 | United Kingdom | 89/14.6 |
| 420006 | 11/1934 | United Kingdom | 89/14.6 |

*Primary Examiner*—Stephen G. Bentley

*Attorney, Agent, or Firm*—McCormick, Paulding & Huber

[57] ABSTRACT

Gases of combustion vented from the bore of a shotgun barrel in spaced relation to the muzzle travel along one or more passageways externally of the barrel and are discharged externally of the barrel and ahead of the muzzle in a generally transverse direction relative to the barrel axis to create turbulence immediately forward of the muzzle and exert lateral forces on a shot charge after the charge leaves the muzzle whereby the short range shot pattern produced by the barrel is substantially enlarged. A finite, moveable mechanical obstruction projecting into the bore retards the advance of a wad to reduce influence of the wad on the shot charge.

11 Claims, 1 Drawing Sheet

HOME SECURITY BARREL ASSEMBLY

BACKGROUND OF THE INVENTION

This invention relates in general to firearm barrels and deals more particularly with an improved shotgun barrel assembly for a home security weapon. It is generally recognized that a shotgun with a shot load is an ideal home security weapon. The devastating effect of such a weapon, when fired at close range, is so well known that the mere brandishment of a shotgun will usually prove sufficient to deter even the most aggressive attacker. However, if it should become necessary to fire the weapon in self-defense, it is essential that the first shot be effective to halt an assailant without placing innocent persons at risk. It is for this reason that special barrel assemblies have been developed for home security use.

An example of a special purpose barrel assembly developed for home security use is found in U.S. Pat. No. 5,155,291 to Dabrowski, entitled Barrel Assembly for Home Security Weapon, issued Oct. 13, 1992, and assigned to the assignee of the present invention. The Dabrowski barrel assembly is particularly adapted to enlarge the short range shot pattern of a 0.410 bore shotgun. Such pattern enlargement improves the short range effectiveness of the weapon while reducing risk of wall penetration which could result in injury to a person or persons in an adjacent room outside of a building in which the weapon is discharged.

The popularity of larger sporting shotguns, such as the 12 gauge shotgun, has created need for a further special purpose barrel assembly particularly adapted to control the close range shot pattern of such a weapon. The sporting barrel assemblies usually provided on such larger shotguns are generally choked to maintain a compact shot pattern at close range. Consequently, the individual pellets which comprise the shot charge tend to act in concert at short range and have the effect of a substantially solid mass, which will readily pass through a wall of an average residential dwelling. However, when the short range shot pattern is spread or substantially enlarged the pellets which comprise the shot charge act individually and generally lack sufficient kinetic energy to pass through the average residential wall.

Accordingly, it is the general aim of the present invention to provide a special purpose barrel assembly for use with a shotgun of larger size to enhance or enlarge the short range shot pattern of the gun and thereby render the gun more ideally suited for use as a home security weapon.

SUMMARY OF THE INVENTION

In accordance with the present invention a home security barrel assembly is provided which includes an axially elongate barrel having a shell chamber at its rear end and a muzzle at its forward end. A bore extends in an axial direction through the barrel from the shell chamber and opens through the muzzle. A gas vent port defined by an opening outwardly through the barrel communicates with the bore and with passageway means externally of the barrel for receiving from the vent port gases of combustion under pressure generated by the detonation of a shotgun shell within the shell chamber. Gases of combustion under pressure and generated by the detonation of a shotgun shell within the shot chamber are discharged from the passageway means externally of the barrel and forward of the muzzle in a transverse direction relative to the axis of the bore.

DESCRIPTION OF PREFERRED EMBODIMENT

Figures 1, 2, 3, 4, 5, 6, 7, 8:
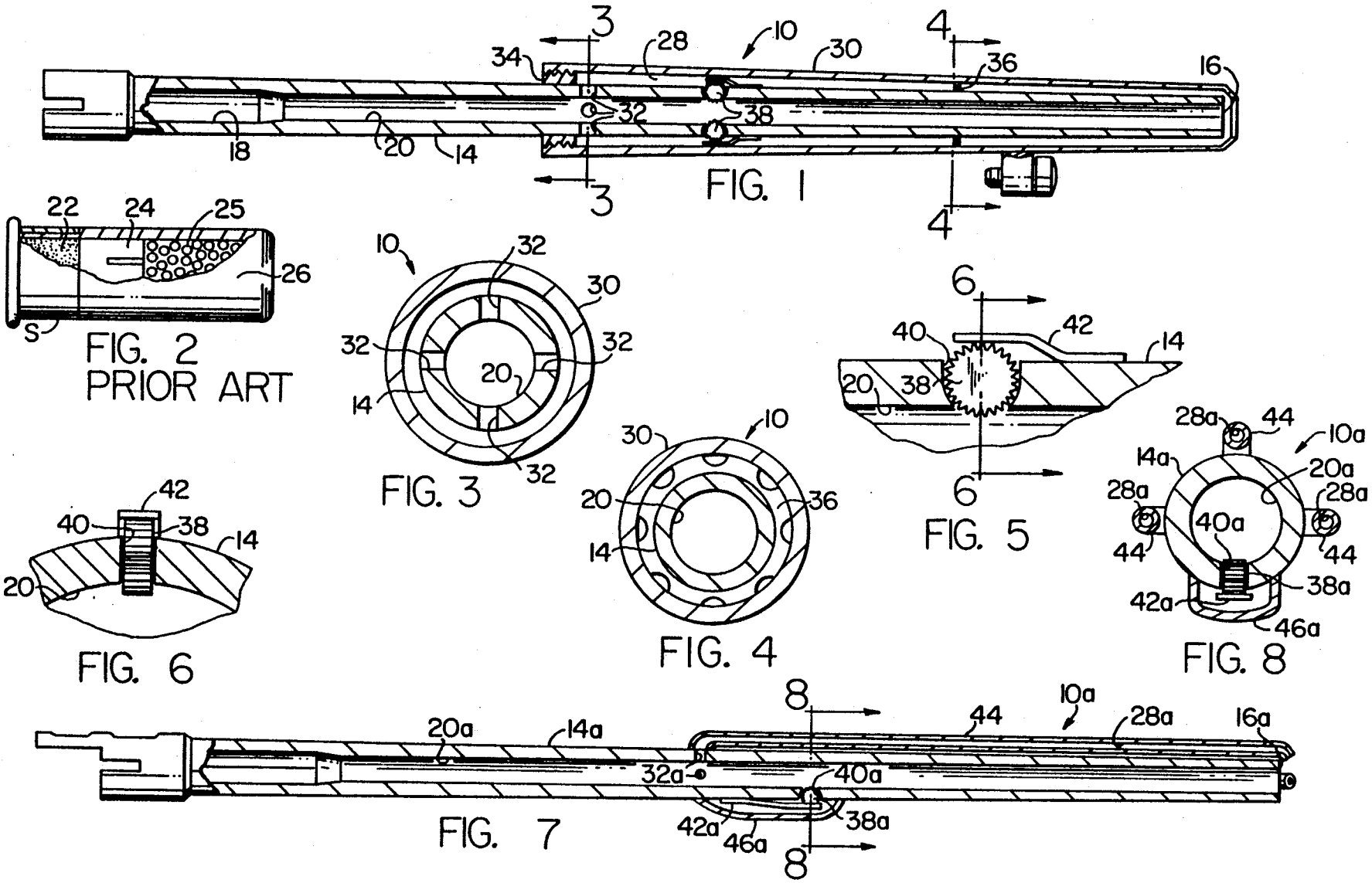
FIG. 2 PRIOR ART
FIG. 1 is a side elevational view of a barrel assembly embodying the invention and shown partially in axial section.
FIG. 2 is a side elevational view of a typical 12 gauge shotgun shell for use in the barrel assembly of FIG. 1, a portion of the shell casing being shown broken away to reveal the contents of the shell.
FIG. 3 is a somewhat enlarged sectional view taken along the line 3—3 of FIG. 1.
FIG. 4 is a somewhat enlarged sectional view taken along the line 4—4 of FIG. 1.
FIG. 5 is a somewhat enlarged fragmentary sectional view of a portion of the barrel assembly shown in FIG. 1.
FIG. 6 is a fragmentary sectional view taken along the line 6—6 of FIG. 5.
FIG. 7 is similar to FIG. 1 but shows another embodiment of the invention.
FIG. 8 is a somewhat enlarged sectional view taken along the line 8—8 of FIG. 7.

Turning now to the drawing, a home security barrel assembly for a shotgun and embodying the present invention is indicated generally by the reference numeral 10. The illustrated barrel assembly 10 is particularly adapted for releasable connection to the receiver of a shotgun, for example, a MOSSBERG Model 500, 12 gauge shotgun, manufactured and marketed by O. F. Mossberg and Sons, Inc., North Haven, Connecticut 06473, and comprises an axially elongate barrel 14 having a muzzle 16 at its forward end. The rear end portion of the barrel 16 defines a shell chamber 18. A bore 20 extends axially through the barrel 14 from the shell chamber 18 and opens through the muzzle 16. The bore 20 is preferably substantially smooth and has or may have a uniform diameter throughout its entire axial length. The illustrated barrel assembly 10 is particularly adapted to receive a conventional 12 gauge shotgun shell. A typical 12 gauge shotgun shell S, shown in FIG. 2, has a propellant charge 22, and a wad 24 disposed forward of the propellent charge and a shot charge 25 formed by a multiplicity of individual pellets disposed forward of the wad, all contained within a conventional shell casing 26.

In accordance with the present invention, a passageway is provided externally of the barrel 14 and in communication with the bore 20 for receiving gases of combustion under pressure generated by the detonation of a shotgun shell within the shell chamber 18 and discharging gases of combustion from the passageway forward of the muzzle 16 and in a generally transverse direction relative to the bore axis. The illustrated barrel assembly 10 has such a passageway indicated at 28 and partially defined by a generally cylindrical barrel shroud 30. The barrel shroud 30 is supported on the barrel 14 in generally radially spaced relation to an outer peripheral surface portion of the barrel and coaxially surrounds at least the forward end portion of the barrel, substantially as shown in FIG. 1. Communication between the bore 20 and the passageway 28 is provided by at least one gas vent port 32 formed in the barrel 14, but preferably, and as shown, the barrel has a plurality of gas vent ports 32, 32 arranged in equangularly spaced relation to each other about the axis of the bore 14, substantially as shown in FIG. 3.

The rear end portion of the barrel shroud 30 is or may be threadably connected to the barrel by an annular ring or collar 34 brazed or otherwise suitably secured in encircling relation to the barrel 14. One or more perforated shroud spacers 36 (one shown) may be secured to the barrel at axially spaced locations along the barrel 14 to maintain the barrel shroud 30 in generally coaxial alignment with the barrel. The forward end portion of the illustrated barrel shroud 30 extends a relatively short distance beyond the muzzle 16 and is turned inwardly toward the bore axis substantially as shown. The inwardly turned end portion of the barrel shroud 30 is spaced from the muzzle 15 and cooperates with the muzzle to form an annular nozzle for directing gases of explosion escaping from the barrel shroud inwardly toward the axis of the bore 20.

Further, and in accordance with the invention, a means is provided for retarding advance of a wad 24 through the barrel 14. Wad advance may be retarded by providing the bore with a choked portion. However, the use of a choked bore portion is presently regarded as counterproductive, since the basic aim of the invention is to spread rather than constrict or choke the shot charge at close range. It is for this reason that a relatively finite mechanical obstruction is provided within the bore and located between the gas vent ports 32, 32 and the muzzle 16.

The presently preferred mechanical obstruction is formed by an angularly moveable rotary member which comprises a circular disc 38 or at least a segment of a disk received within a substantially complementary arcuate recess 40 formed in the wall of the barrel 14 and communicating with the bore 20. The disc 38 has a knurled or roughened outer peripheral surface, a substantially minute portion of which is exposed within the bore 20. The disc 38 is retained in assembly with the barrel 14 for angular movement relative to the barrel by a flat spring member 42 mounted in cantilever position on the outer surface of the barrel 14 and disposed in overlying relation to a portion of the disc 38. The disc 38 will engage a peripheral portion of a wad 24 and effectively retard forward movement of the wad 24, thereby substantially eliminating any further influence the wad may exert upon a shot charge 25 and without materially effecting the travel of the shot charge through the bore 20.

Slowing the advance of a wad in the aforedescribed manner affords further opportunity for expanding gases of combustion, under pressure, trapped in the bore behind the wad to escape from the bore 20 along paths defined by the vent ports 32, 32 and the barrel shroud 30 and reach the discharge point forward of the muzzle as a shot charge 25 leaves the muzzle. The resulting turbulence immediately forward of the muzzle causes separation or spreading of the shot charge to produce an enlarged close range shot pattern. The transversely directed force of the gases acting upon the individual pellets which comprise the shot charge as it leaves the muzzle will result in some loss of shot charge energy, but this is not objectionable. The resulting increase in the size of the short range shot pattern increases the probability that a single shot will be effective to halt an assailant. Further, it is unlikely that the kinetic energy of the individual pellets which comprise the spread or enlarged shot pattern will be sufficient to produce significant wall penetration.

In FIG. 7 and 8 there is shown another barrel assembly embodying the present invention and indicated generally by the reference numeral **10*a*. Parts of the assembly 10*a* which are substantially identical to parts of the assembly 10**, previously described, bear the same reference numerals as the previously described parts and a letter "a" suffix and will not be hereinafter further described in detail.

The barrel assembly **10*a* includes a barrel 14*a* having a mizzle 16*a* and a bore 20*a*. In accordance with the invention at least one vent port formed in the wall of the barrel communicates with the bore and opens outwardly through the barrel. However, preferably, and as shown, the barrel 14*a* has a plurality of such vent ports 32*a*, 32*a*. A separate tube 44 communicates with each of the vent ports exteriorly of the barrel and defines a passageway 28*a*. Each tube 44 extends in the direction of the muzzle and projects forwardly beyond the muzzle 16*a*. The forward end of each tube 44 is turned inwardly in the direction of the axis of the bore 20*a* and forms a nozzle for directing gases of explosion under pressure towards the bore axis immediately forward of the muzzle to exert lateral force upon a shot charge as it leaves the muzzle causing turbulence and a resulting spreading of the short range shot pattern. The barrel 14*a* also includes a wad retarding member substantially similar to the wad retarding member previously described. However, the wad retarding member used in the barrel assembly 10*a* comprises only a segment of a disk indicated at 38*a*. A blister or bubble 46*a* attached to the outer surface of the barrel 14*a* provides an enclosure for the wad retarding device and prevents the further escape of any gas which may pass from the bore through the recess 40*a* which contains the wad retarding member 38*a***.

I claim:

1. A home security shotgun barrel assembly comprising an axially elongate barrel having a shell chamber at its rear end for receiving a shotgun shell containing a propellant charge, a wad forward of said propellant charge and a shot charge forward of the wad, and said barrel having a muzzle at its forward end, a bore extending in an axial direction through said barrel from said shell chamber and opening through said muzzle, wad engaging means exposed within said bore for retarding the advance of a wad through said bore and including moveable member supported for angular movement relative to said barrel and defining a finite projection extending into said bore and a flat spring mounted in cantilever position on said barrel in overlying relation to said member and retaining said member in assembly with said barrel, a gas vent port defined by and opening outwardly through said barrel and communicating with said bore, and passageway means externally of said barrel and communicating with said vent port for receiving from said vent port gases of combustion under pressure generated by the detonation of a shotgun shell within said shell chamber and discharging gases of combustion externally of the barrel forward of said muzzle and in a transverse direction relative to and across the axis of said bore.

2. A home security barrel assembly as set forth in claim 1 wherein said moveable member has an arcuate peripheral surface portion defining said finite projection.

3. A home security barrel assembly as set forth in claim 2 wherein said moveable member comprises at least a segment of a circular disk supported within a complimentary recess in said barrel communicating with said bore.

4. A home security barrel assembly as set forth in claim 1 wherein said passageway defining means comprises a tubular member.

5. A home security barrel assembly as set forth in claim 4 wherein said barrel assembly includes means for releasably retaining said tubular member in assembly with said barrel.

6. A home security barrel assembly as set forth in claim 4 wherein said passageway defining means comprises a barrel shroud surrounding a portion of said barrel.

7. A home security barrel assembly as set forth in claim 1 wherein said passageway means comprises a tube extending along the outer peripheral surface of said barrel.

8. A home security barrel assembly as set forth in claim 1 wherein said bore is cylindrical and has a uniform diameter throughout the entire length thereof.

9. A home security barrel assembly as set forth in claim 8 wherein said bore has a substantially smooth bore wall.

10. A home security shotgun barrel assembly comprising an elongate barrel having a shell chamber at the rear end thereof for receiving and containing a shotgun shell having a shell casing containing a propellent charge, a wad, and a shot charge including a multiplicity of individual pellets, said barrel having a muzzle at the forward end thereof and a bore having a bore axis and extending axially forwardly from said shell chamber and opening outwardly through said muzzle, wad retarding means for slowing forward movement of a wad through said bore in response to pressure of gases of explosion generated by detonation of a shotgun shell within said shell chamber and including a moveable member supported for angular movement relative to said barrel and defining a finite projection extending into said bore for engaging a portion of the peripheral edge of an advancing wad before the advancing wad leaves said muzzle and a flat spring mounted in cantilever position on said barrel in overlying relation to said member and retaining said member in assembly with said barrel, at least one vent port formed in the barrel forward of said shell chamber and communicating with said bore, and passageway defining means externally of said barrel in communication with said one vent port for receiving gases of explosion under pressure from said one vent port and discharging gases of explosion externally of said barrel forward of said muzzle and transversely across said bore axis and into and across the path of the shot charge as the shot charge leaves said muzzle whereby to enlarge the short range shot pattern of said shotgun barrel assembly.

11. A home security barrel assembly as set forth in claim 10 wherein said one vent port communicates with said bore between said shell chamber and said wad retarding means.

* * * * *